US011024231B2

(12) United States Patent
Gao et al.

(10) Patent No.: US 11,024,231 B2
(45) Date of Patent: Jun. 1, 2021

(54) PIXEL DRIVING CIRCUIT, PIXEL DRIVING METHOD AND DISPLAY DEVICE

(71) Applicant: BOE TECHNOLOGY GROUP CO., LTD., Beijing (CN)

(72) Inventors: Xueling Gao, Beijing (CN); Kuanjun Peng, Beijing (CN); Wei Qin, Beijing (CN); Wanpeng Teng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/631,777

(22) PCT Filed: Aug. 30, 2019

(86) PCT No.: PCT/CN2019/103593
§ 371 (c)(1),
(2) Date: Jan. 16, 2020

(87) PCT Pub. No.: WO2020/143234
PCT Pub. Date: Jul. 16, 2020

(65) Prior Publication Data

US 2020/0342813 A1 Oct. 29, 2020

(30) Foreign Application Priority Data

Jan. 7, 2019 (CN) ..... 201910011281.3

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2310/0251* (2013.01); *G09G 2320/045* (2013.01)

(58) Field of Classification Search
None
See application file for complete search history.

(56) References Cited

U.S. PATENT DOCUMENTS

2005/0007353 A1* 1/2005 Smith ..... G09G 3/3233 345/204
2005/0280614 A1* 12/2005 Goh ..... G09G 3/3233 345/76

(Continued)

FOREIGN PATENT DOCUMENTS

CN 104008723 A 8/2014
CN 104112766 A 10/2014

(Continued)

OTHER PUBLICATIONS

Andi, "Transistors: What is the difference between BJT, FET and MOSFET?", pp. 1-3, 2014 (Year: 2014).*

(Continued)

*Primary Examiner* — Dorothy Harris
(74) *Attorney, Agent, or Firm* — Muncy, Geissler, Olds and Lowe, P.C.

(57) ABSTRACT

A pixel driving circuit is provided. The pixel driving circuit includes an initialization circuit, a driving circuit, and a first light-emitting control circuit. A first terminal of the driving circuit is coupled to a power voltage terminal, a second terminal of the driving circuit is coupled to a light-emitting element via the first light-emitting control circuit. The initialization circuit is configured to write an initialization voltage to a control terminal of the driving circuit under control of an initialization control signal input from an initialization control line, so that the driving circuit brings a connection between the first and second terminals into a conducting state under control of the control terminal. The first light-emitting control circuit is configured to bring a connection between the second terminal and the light-emitting element into a conducting state under control of a first light-emitting control signal input from a first light-emitting control line.

18 Claims, 9 Drawing Sheets

(56) References Cited

U.S. PATENT DOCUMENTS

| | | | | |
|---|---|---|---|---|
| 2007/0024541 | A1* | 2/2007 | Ryu | G09G 3/3283 345/76 |
| 2008/0036710 | A1* | 2/2008 | Kim | G09G 3/3233 345/82 |
| 2009/0108763 | A1 | 4/2009 | Han et al. | |
| 2014/0240368 | A1 | 8/2014 | Koh | |
| 2015/0187270 | A1 | 7/2015 | Lee et al. | |
| 2015/0348462 | A1* | 12/2015 | Ma | G09G 3/3225 345/78 |
| 2016/0027848 | A1 | 1/2016 | Liu et al. | |
| 2016/0133191 | A1 | 5/2016 | Kang et al. | |
| 2016/0247443 | A1 | 8/2016 | Yang | |
| 2016/0275854 | A1 | 9/2016 | Wang et al. | |
| 2016/0284276 | A1* | 9/2016 | Gupta | G09G 3/3225 |
| 2016/0370655 | A1 | 12/2016 | Nagayama et al. | |
| 2017/0025062 | A1 | 1/2017 | Wang | |
| 2017/0194387 | A1 | 7/2017 | Oh et al. | |
| 2018/0190921 | A1 | 7/2018 | Liao | |
| 2018/0202616 | A1 | 7/2018 | Yoon et al. | |
| 2019/0005885 | A1* | 1/2019 | Kim | H01L 27/1218 |
| 2019/0066580 | A1 | 2/2019 | Xu | |
| 2019/0114970 | A1* | 4/2019 | Moradi | G09G 3/3291 |
| 2019/0213957 | A1 | 7/2019 | Gao et al. | |
| 2019/0295476 | A1 | 9/2019 | Ji et al. | |
| 2019/0371238 | A1 | 12/2019 | Gao et al. | |

FOREIGN PATENT DOCUMENTS

| | | | |
|---|---|---|---|
| CN | 104167170 | A | 11/2014 |
| CN | 104536198 | A | 4/2015 |
| CN | 104658484 | A | 5/2015 |
| CN | 104992674 | A | 10/2015 |
| CN | 105156931 | A | 12/2015 |
| CN | 106094339 | A | 11/2016 |
| CN | 106531775 | A | 3/2017 |
| CN | 106652915 | A | 5/2017 |
| CN | 106935714 | A | 7/2017 |
| CN | 107346654 | A | 11/2017 |
| CN | 107919093 | A | 4/2018 |
| CN | 207352944 | U | 5/2018 |
| CN | 108333826 | A | 7/2018 |
| CN | 108333833 | A | 7/2018 |
| CN | 108735155 | A | 11/2018 |
| CN | 109065740 | A | 12/2018 |
| CN | 109509428 | A | 3/2019 |
| WO | WO 2006009612 | A1 | 1/2006 |

OTHER PUBLICATIONS

Triode definition downloaded from https://www.thefreedictionary.com/triode on Nov. 6, 2020 (Year: 2020).*

Office Action of CN Application No. 201910011281.3 and English translation, dated Feb. 10, 2020, 13 pages.

Office Action of CN Application No. 201810908575.1 and English translation, dated Sep. 9, 2019, 22 pages.

International Search Report of PCT/CN2019/099788 and English translation, dated Oct. 30, 2019, 14 pages.

* cited by examiner

PIXEL DRIVING CIRCUIT, PIXEL DRIVING METHOD AND DISPLAY DEVICE

CROSS-REFERENCE TO RELATED APPLICATION

This application is a U.S. national phase application of a PCT Application No. PCT/CN2019/103593 filed on Aug. 30, 2019, which claims priority to Chinese Patent Application No. 201910011281.3 filed in China on Jan. 7, 2019, the disclosures of which are incorporated herein in their entirety by reference.

TECHNICAL FIELD

The present disclosure relates to the field of display driving technique, and in particular to a pixel driving circuit, a pixel driving method, and a display device.

BACKGROUND

In a conventional organic light-emitting diode (OLED) display product, due to a hysteresis effect of a driving transistor, when the screen switches to display a 48 gray-scale image following a display of a black-and-white image for a while, a residual image may result, which will disappear after a while. The phenomenon is referred to as short-term image sticking.

The hysteresis effect is mainly caused by a threshold voltage deviation of the driving transistor. In a conventional compensation circuit, a gate-source voltage VGS of the driving transistor in initialization stage may vary during different image switching processes, resulting in the short-term image sticking. A conventional technical solution for eliminating the short-term image sticking is as follows: during the initialization stage the driving transistor is charged and discharged repeatedly, and meanwhile light-emitting is prevented by not energizing a light-emitting control line until the driving transistor is stabilized, so as to solve the problem of the short-term image sticking. However, the conventional technical solution for solving the short-term image sticking problem is too complicated, and needs to be further improved.

SUMMARY

In a first aspect, a pixel driving circuit is provided in an embodiment of the present disclosure. The pixel driving circuit includes an initialization circuit, a driving circuit and a first light-emitting control circuit. A first terminal of the driving circuit is coupled to a power voltage terminal, a second terminal of the driving circuit is coupled to a light-emitting element via the first light-emitting control circuit. The initialization circuit is configured to write an initialization voltage to a control terminal of the driving circuit under control of an initialization control signal input from an initialization control line, so that the driving circuit brings a connection between the first terminal of the driving circuit and the second terminal of the driving circuit into a conducting state under control of the control terminal of the driving circuit. The first light-emitting control circuit is configured to bring a connection between the second terminal of the driving circuit and the light-emitting element into a conducting state under control of a first light-emitting control signal input from a first light-emitting control line.

According to some optional embodiments of the present disclosure, the pixel driving circuit further includes an energy storage circuit, a data writing circuit, and a compensation control circuit, where the data writing circuit is configured to write a data voltage to a first terminal of the energy storage circuit under control of a writing control signal input from a writing control line; a second terminal of the energy storage circuit is coupled to the control terminal of the driving circuit; and the compensation control circuit is configured to bring a connection between the control terminal of the driving circuit and the second terminal of the driving circuit into a conducting state and write a first voltage to the first terminal of the energy storage circuit under control of a compensation control signal input from a compensation control line.

According to some optional embodiments of the present disclosure, the compensation control circuit is configured to bring a connection between the first terminal of the energy storage circuit and a first electrode of the light-emitting element into a conducting state under control of the compensation control signal, so as to write the first voltage to the first terminal of the energy storage circuit.

According to some optional embodiments of the present disclosure, the pixel driving circuit further includes a second light-emitting control circuit; the first terminal of the driving circuit is coupled to the power voltage terminal via the second light-emitting control circuit, and the second light-emitting control circuit is configured to bring a connection between the first terminal of the driving circuit and the power voltage terminal into a conducting state under control of a second light-emitting control signal input from a second light-emitting control line.

According to some optional embodiments of the present disclosure, the initialization circuit includes an initialization transistor; a control electrode of the initialization transistor is coupled to the initialization control line, a first electrode of the initialization transistor is coupled to an initialization voltage line, and a second electrode of the initialization transistor is coupled to the control terminal of the driving circuit; the initialization voltage line is configured to input the initialization voltage.

According to some optional embodiments of the present disclosure, the first light-emitting control circuit includes a first light-emitting control transistor; a control electrode of the first light-emitting control transistor is coupled to the first light-emitting control line, a first electrode of the first light-emitting control transistor is coupled to the second terminal of the driving circuit, and a second electrode of the first light-emitting control transistor is coupled to a first electrode of the light-emitting element.

According to some optional embodiments of the present disclosure, the driving circuit includes a driving transistor; a control electrode of the driving transistor is the control terminal of the driving circuit, a first electrode of the driving transistor is the first terminal of the driving circuit, and a second electrode of the driving transistor is the second terminal of the driving circuit.

According to some optional embodiments of the present disclosure, the compensation control circuit includes a first compensation control transistor and a second compensation control transistor, where a control electrode of the first compensation control transistor is coupled to the compensation control line, a first electrode of the first compensation control transistor is coupled to the control terminal of the driving circuit, and a second electrode of the first compensation control transistor is coupled to the second terminal of the driving circuit; and a control electrode of the second compensation control transistor is coupled to the compensation control line, a first electrode of the second compensation control transistor is coupled to the first terminal of the energy storage circuit, and a second electrode of the second compensation control transistor is coupled to a first electrode of the light-emitting element.

According to some optional embodiments of the present disclosure, the energy storage circuit includes a storage capacitor, and the data writing circuit includes a data writing transistor, where a first terminal of the storage capacitor is the first terminal of the energy storage circuit, and a second terminal of the storage capacitor is the second terminal of the energy storage circuit; and a control electrode of the data writing transistor is coupled to the writing control line, a first electrode of the data writing transistor is coupled to a data line, and a second electrode of the data writing transistor is coupled to the first terminal of the energy storage circuit; the data line is configured to input the data voltage.

According to some optional embodiments of the present disclosure, the second light-emitting control circuit includes a second light-emitting control transistor; a control electrode of the second light-emitting control transistor is coupled to the second light-emitting control line, a first electrode of the second light-emitting control transistor is coupled to the power voltage terminal, and a second electrode of the second light-emitting control transistor is coupled to the first terminal of the driving circuit.

According to some optional embodiments of the present disclosure, each transistor is a triode.

According to some optional embodiments of the present disclosure, each transistor is a thin film transistor.

According to some optional embodiments of the present disclosure, each transistor is a field effect transistor.

According to some optional embodiments of the present disclosure, each transistor is a P-type metal-oxide-semiconductor field effect transistor (PMOSFET).

According to some optional embodiments of the present disclosure, the pixel driving circuit is of a 7T1C configuration including seven transistors and one capacitor.

In a second aspect, a pixel driving method is further provided in an embodiment of the present disclosure. The pixel driving method is applied to the pixel driving circuit as described in the first aspect, and includes: during an initialization stage, writing, by the initialization circuit, the initialization voltage to the control terminal of the driving circuit under control of the initialization control signal input from the initialization control line, so that the driving circuit brings the connection between the first terminal of the driving circuit and the second terminal of the driving circuit into a conducting state under control of the control terminal of the driving circuit; and disconnecting, by the first light-emitting control circuit, the connection between the second terminal of the driving circuit and the light-emitting element under control of the first light-emitting control signal input from the first light-emitting control line.

According to some optional embodiments of the present disclosure, the pixel driving circuit further includes an energy storage circuit, a compensation control circuit, and a second light-emitting control circuit, a compensation stage is further provided after the initialization stage, and the pixel driving method further includes: during the compensation stage, bringing, by the second light-emitting control circuit, a connection between the first terminal of the driving circuit and the power voltage terminal into a conducting state under control of a second light-emitting control signal input from a second light-emitting control line; bringing, by the compensation control circuit, a connection between the control terminal of the driving circuit and the second terminal of the driving circuit into a conducting state and bringing, by the compensation control circuit, a connection between a first electrode of the light-emitting element and a first terminal of the energy storage circuit into a conducting state under control of a compensation control signal input from a compensation control line; and bringing, by the driving circuit, the connection between the first terminal of the driving circuit and the second terminal of the driving circuit into a conducting state under control of the control terminal of the driving circuit to charge the energy storage circuit with a power voltage input from the power voltage terminal, so as to increase an electrical potential on the control terminal of the driving circuit until the driving circuit disconnects the connection between the first terminal of the driving circuit and the second terminal of the driving circuit under control of the control terminal of the driving circuit.

According to some optional embodiments of the present disclosure, the pixel driving circuit further includes a data writing circuit, a data writing stage and a light-emitting stage are further provided after the compensation stage; the pixel driving method further includes: during the data writing stage, writing, by the data writing circuit, a data voltage to the first terminal of the energy storage circuit under control of a writing control signal input from a writing control line so as to change an electrical potential on a second terminal of the energy storage circuit accordingly; during the light-emitting stage, bringing, by the first light-emitting control circuit, a connection between the second terminal of the driving circuit and the first electrode of the light-emitting element into a conducting state under control of a first light-emitting control signal input from a first light-emitting control line; bringing, by the second light-emitting control circuit, a connection between the first terminal of the driving circuit and the power voltage terminal into a conducting state under control of a second light-emitting control signal; and driving, by the driving circuit, the light-emitting element to emit light.

In a third aspect, a display device is further provided in an embodiment of the present disclosure. The display device includes the pixel driving circuit as described in the first aspect.

According to some optional embodiments of the present disclosure, the display device is an organic light-emitting diode (OLED) display device.

BRIEF DESCRIPTION OF THE DRAWINGS

In order to illustrate the technical solutions of embodiments of the present disclosure or in the prior art in a clearer manner, the drawings required for the descriptions of the embodiments of the present disclosure or the prior art will be introduced hereinafter briefly. Obviously, the following drawings merely relate to some embodiments of the present disclosure, and based on these drawings, a person skilled in the art may obtain other drawings without any creative effort.

DETAILED DESCRIPTION

The technical solutions in the embodiments of the present disclosure will be described hereinafter clearly and completely with reference to the drawings of the embodiments of the present disclosure. Obviously, the following embodiments merely relate to a part of, rather than all of, the embodiments of the present disclosure, and based on these embodiments, a person of ordinary skill in the art may, without any creative effort, obtain other embodiments, which also fall within the scope of the present disclosure.

A transistor used in the embodiments of the present disclosure may be a triode, a thin film transistor, a field effect transistor or other device with same characteristics. In the embodiments of the present disclosure, in order to distinguish between two electrodes, other than a control electrode, of a transistor, one electrode of the two electrodes of the transistor is referred to as a first electrode and the other electrode of the two electrodes of the transistor is referred to as a second electrode.

In practice, when the transistor is a triode, the control electrode of the transistor may be a base electrode, the first electrode of the transistor may be a collector electrode, and the second electrode of the transistor may be an emitter electrode. Alternatively, the control electrode of the transistor may be a base electrode, the first electrode of the transistor may be an emitter electrode, and the second electrode of the transistor may be a collector electrode.

In practice, when the transistor is a thin film transistor or a field effect transistor, the control electrode of the transistor may be a gate electrode, the first electrode of the transistor may be a drain electrode, and the second electrode of the transistor may be a source electrode. Alternatively, the control electrode of the transistor may be a gate electrode, the first electrode of the transistor may be a source electrode, and the second electrode of the transistor may be a drain electrode.

Figure 1:
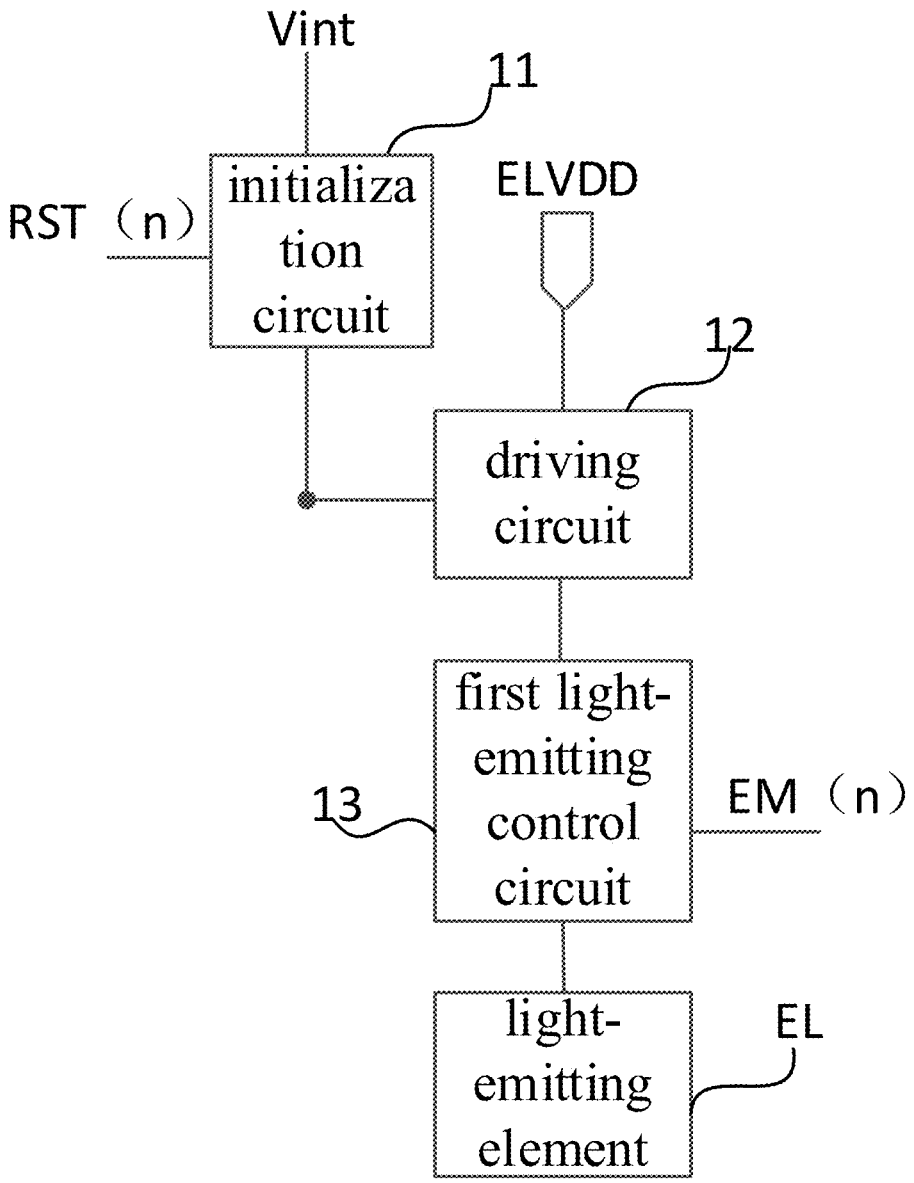
FIG. 1 is a structural diagram of a pixel driving circuit according to an embodiment of the present disclosure.

As shown in FIG. 1, the pixel driving circuit according to an embodiment of the present disclosure is configured to drive a light-emitting element EL. The pixel driving circuit includes an initialization circuit 11, a driving circuit 12 and a first light-emitting control circuit 13.

A first terminal of the driving circuit 12 is coupled to a power voltage terminal (i.e., a terminal used to input power voltage ELVDD), a second terminal of the driving circuit 12 is coupled to the light-emitting element EL via the first light-emitting control circuit 13.

The initialization circuit 11 is coupled to an initialization control line RST(n), an initialization voltage line (i.e., a voltage line used to input an initialization voltage Vint), and a control terminal of the driving circuit 12 respectively. The initialization circuit 11 is configured to write the initialization voltage Vint on the initialization voltage line to the control terminal of the driving circuit 12 under control of an initialization control signal input from the initialization control line RST(n), so that the driving circuit 12 brings a connection between the first terminal of the driving circuit 12 and the second terminal of the driving circuit 12 into a conducting state under control of the control terminal of the driving circuit 12.

The first light-emitting control circuit 13 is coupled to a first light-emitting control line EM(n), the second terminal of the driving circuit 12, and the light-emitting element EL respectively. The first light-emitting control circuit 13 is configured to bring a connection between the second terminal of the driving circuit 12 and the light-emitting element EL into a conducting state under control of a first light-emitting control signal input from the first light-emitting control line EM(n).

According to the pixel driving circuit of the embodiment of the present disclosure, an electrical potential on the control terminal of the driving circuit 12 is set to the initialization voltage Vint during the initialization stage by using the initialization circuit 11, to place a driving transistor included in the driving circuit 12 in an on-bias state, such that regardless of whether a data voltage during a display time of a previous frame corresponds to black or white color, the driving transistor included in the driving circuit 12 initiates compensation and data writing processes from the on-bias state.

When the embodiment of the pixel driving circuit as shown in FIG. 1 of the present disclosure is in operation, during an initialization stage, the initialization circuit 11 writes the initialization voltage Vint to the control terminal of the driving circuit 12 under control of the initialization control signal input from the initialization control line RST(n), so that the driving circuit 12 brings the connection between the first terminal of the driving circuit 12 and the second terminal of the driving circuit 12 into a conducting state under control of the control terminal of the driving circuit 12. Further, the first light-emitting control circuit 13 disconnects the connection between the second terminal of the driving circuit 12 and the light-emitting element EL under control of the first light-emitting control signal input from the first light-emitting control line EM(n).

Figure 2:
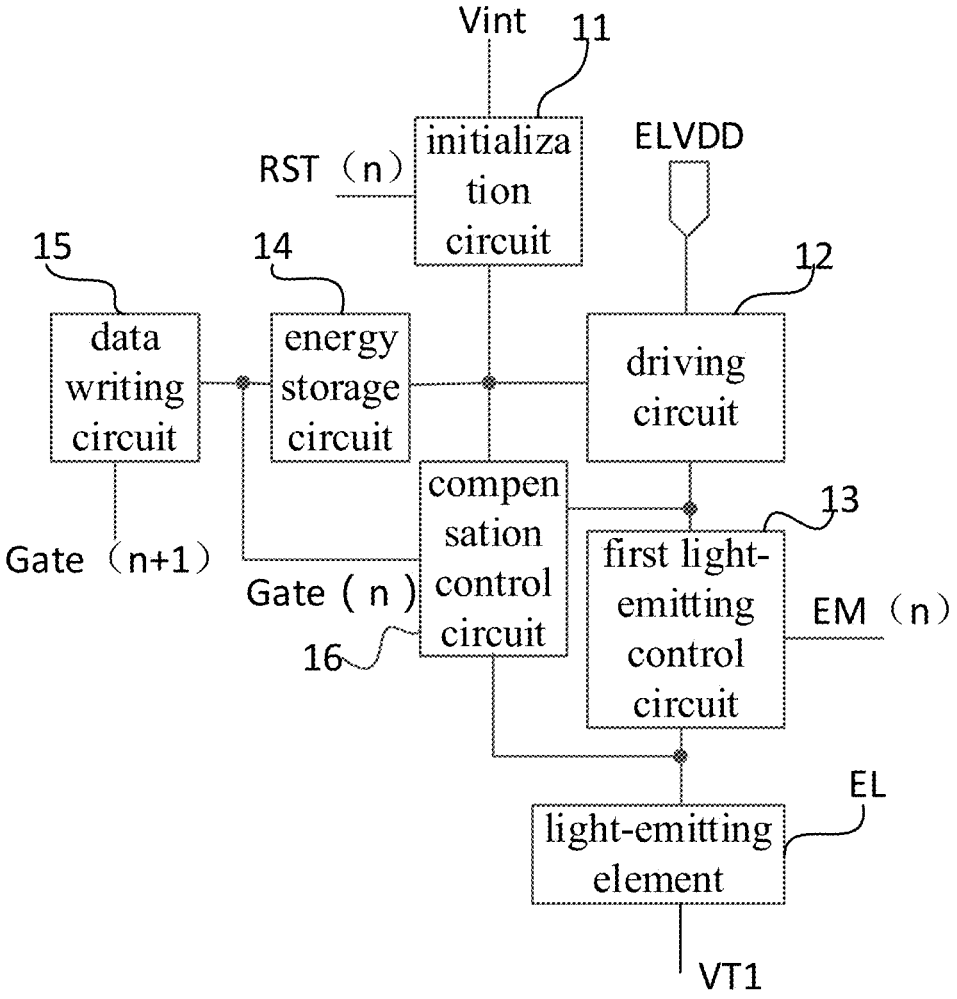
FIG. 2 is a structural diagram of a pixel driving circuit according to another embodiment of the present disclosure.

In a specific implementation, as shown in FIG. 2, the pixel driving circuit may further include an energy storage circuit 14, a data writing circuit 15, and a compensation control circuit 16.

The data writing circuit 15 is configured to write a data voltage to a first terminal of the energy storage circuit 14 under control of a writing control signal input from a writing control line; a second terminal of the energy storage circuit 14 is coupled to the control terminal of the driving circuit 12.

The compensation control circuit 16 is configured to bring the connection between the control terminal of the driving circuit 12 and the second terminal of the driving circuit 12 into a conducting state and write a first voltage to the first terminal of the energy storage circuit 14 under control of a compensation control signal input from a compensation control line.

By employing the energy storage circuit 14, the data writing circuit 15 and the compensation control circuit 16 in the pixel driving circuit according to the embodiment of the present disclosure, a threshold voltage compensation and a power voltage compensation may be performed during a compensation stage provided after the initialization stage, such that a current flowing via the light-emitting element EL during a light-emitting stage may be unaffected by a threshold voltage of the driving transistor included in the driving circuit 12, and unaffected by a IR drop of power voltage. The IR drop refers to a phenomenon of voltage drop or rise occurring in a power and ground network in an integrated circuit.

In a specific implementation, the compensation control circuit 16 may connect the first terminal of the energy storage circuit 14 to a first voltage line under control of the compensation control signal, so as to write the first voltage to the first terminal of the energy storage circuit 14; the first voltage line is configured to input the first voltage.

According to another specific implementation, the compensation control circuit 16 may be configured to bring a connection between the first terminal of the energy storage circuit 14 and a first electrode of the light-emitting element EL into a conducting state under control of the compensation control signal, so as to write the first voltage to the first terminal of the energy storage circuit 14. At this time, the first voltage may be a turn-on voltage of the light-emitting element EL. By using the first electrode of the light-emitting element EL to provide the first terminal of the energy storage circuit 14 with the first voltage, a quantity of coupled signal lines may be reduced by one (i.e., the first voltage line is eliminated).

In a specific implementation, the light-emitting element EL may be an organic light-emitting diode (OLED), a first electrode of the light-emitting element EL may be an anode of the organic light-emitting diode, and a second electrode of the light-emitting diode EL may be a cathode of the organic light-emitting diode, but the disclosure is not limited thereto.

As shown in FIG. 2, based on the embodiment of the pixel driving circuit as shown in FIG. 1, the pixel driving circuit according to the embodiment of the present disclosure further includes the energy storage circuit 14, the data writing circuit 15 and the compensation control circuit 16.

The data writing circuit 15 is configured to write a data voltage Vdata to the first terminal of the energy storage circuit 14 under control of the writing control signal input from a writing control line Gate(n+1); the second terminal of the energy storage circuit 14 is coupled to the control terminal of the driving circuit 12.

The compensation control circuit 16 is configured to bring the connection between the control terminal of the driving circuit 12 and the second terminal of the driving circuit 12 into a conducting state and bring the connection between the first terminal of the energy storage circuit 14 and the first electrode of the light-emitting element EL into a conducting state under control of the compensation control signal input from a compensation control line Gate(n); a second electrode of the light-emitting element EL is coupled to a cathode voltage terminal VT1.

When an embodiment of the pixel driving circuit as shown in FIG. 2 of the present disclosure is in operation, a compensation stage, a data writing stage and a light-emitting stage are further provided after the initialization stage.

During the compensation stage, the compensation control circuit 16 brings the connection between the control terminal of the driving circuit 12 and the second terminal of the driving circuit 12 into a conducting state and brings a connection between the first electrode of the light-emitting element EL and the first terminal of the energy storage circuit 14 into a conducting state under control of the compensation control signal input from the compensation control line Gate(n). The driving circuit 12 brings the connection between the first terminal of the driving circuit 12 and the second terminal of the driving circuit 12 into a conducting state under control of the control terminal of the driving circuit 12 to charge the energy storage circuit 14 with the power voltage ELVDD input from the power voltage terminal, so as to increase the electrical potential on the control terminal of the driving circuit 12 until the driving circuit 12 disconnects the connection between the first terminal of the driving circuit 12 and the second terminal of the driving circuit 12 under control of the control terminal of the driving circuit 12.

During the data writing stage, the data writing circuit 15 writes the data voltage to the first terminal of the energy storage circuit 14 under control of the writing control signal input from the writing control line Gate(n+1) so as to change an electrical potential on the second terminal of the energy storage circuit 14 accordingly.

During the light-emitting stage, the first light-emitting control circuit 13 brings a connection between the second terminal of the driving circuit 12 and the first electrode of the light-emitting element EL into a conducting state under control of the first light-emitting control signal input from the first light-emitting control line EM(n), and the driving circuit 12 drives the light-emitting element EL to emit light.

Figure 3:
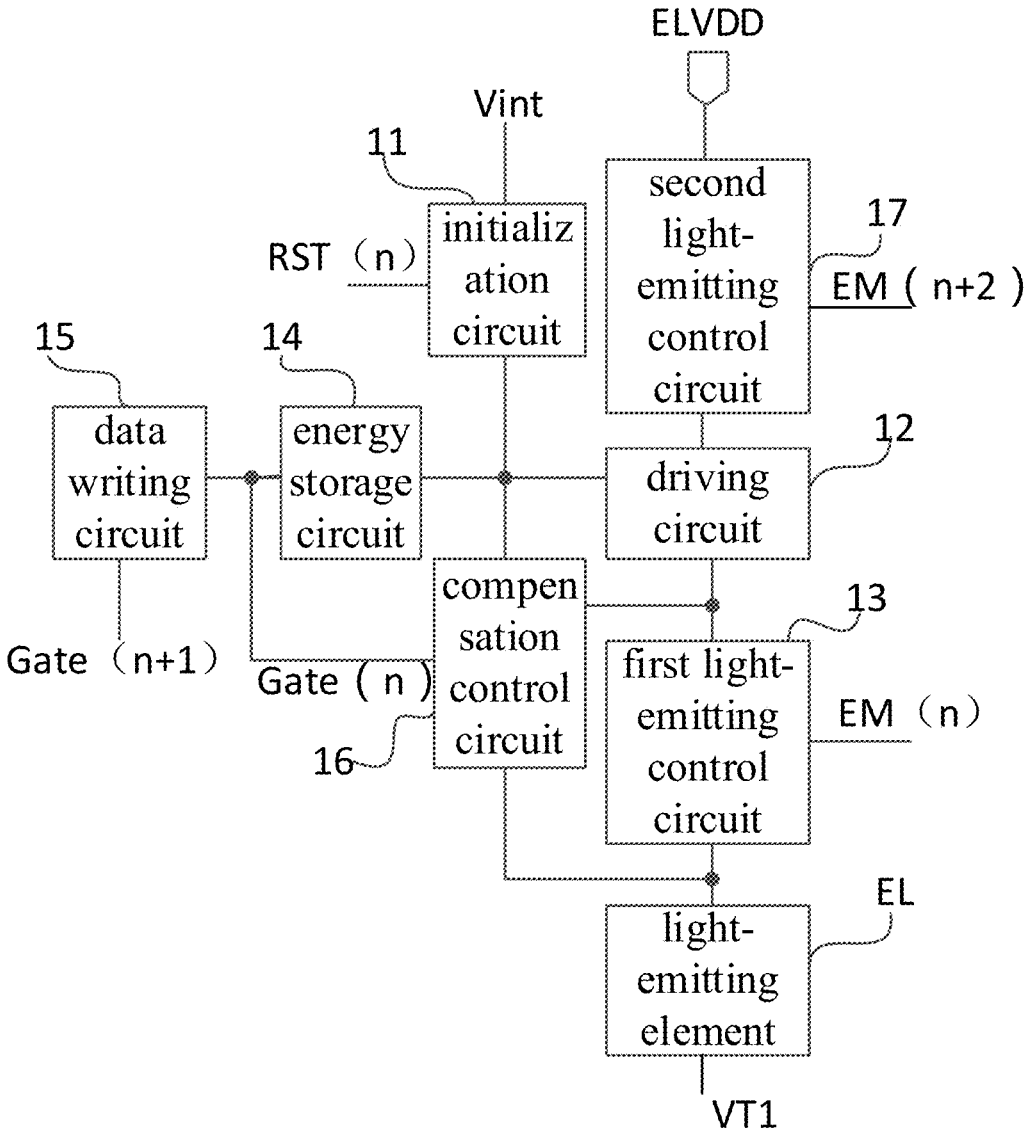
FIG. 3 is a structural diagram of a pixel driving circuit according to still another embodiment of the present disclosure.

Specifically, as shown in FIG. 3, based on the pixel driving circuit as shown in FIG. 2, the pixel driving circuit according to the embodiment of the present disclosure may further include a second light-emitting control circuit 17.

The first terminal of the driving circuit 12 is coupled to the power voltage terminal via the second light-emitting control circuit 17, and the second light-emitting control circuit 17 is configured to bring a connection between the first terminal of the driving circuit 12 and the power voltage terminal into a conducting state under control of a second light-emitting control signal input from a second light-emitting control line EM(n+2).

The power voltage terminal is configured to input the power voltage ELVDD.

When the embodiment of the pixel driving circuit as shown in FIG. 3 of the present disclosure is in operation, during the compensation stage, the second light-emitting control circuit 17 brings the connection between the first terminal of the driving circuit 12 and the power voltage terminal into a conducting state under control of the second light-emitting control signal input from the second light-emitting control line EM(n+2).

During the light-emitting stage, the second light-emitting control circuit 17 brings the connection between the first terminal of the driving circuit 12 and the power voltage terminal into a conducting state under control of the second light-emitting control signal.

Specifically, the initialization circuit may include an initialization transistor.

A control electrode of the initialization transistor is coupled to the initialization control line, a first electrode of the initialization transistor is coupled to the initialization voltage line, and a second electrode of the initialization transistor is coupled to the control terminal of the driving circuit; the initialization voltage line is configured to input the initialization voltage.

Specifically, the first light-emitting control circuit may include a first light-emitting control transistor.

A control electrode of the first light-emitting control transistor is coupled to the first light-emitting control line, a first electrode of the first light-emitting control transistor is coupled to the second terminal of the driving circuit, and a second electrode of the first light-emitting control transistor is coupled to the first electrode of the light-emitting element.

Specifically, the driving circuit may include a driving transistor.

A control electrode of the driving transistor is the control terminal of the driving circuit, a first electrode of the driving transistor is the first terminal of the driving circuit, and a second electrode of the driving transistor is the second terminal of the driving circuit.

In a specific implementation, the compensation control circuit may include a first compensation control transistor and a second compensation control transistor.

A control electrode of the first compensation control transistor is coupled to the compensation control line, a first electrode of the first compensation control transistor is coupled to the control terminal of the driving circuit, and a second electrode of the first compensation control transistor is coupled to the second terminal of the driving circuit.

A control electrode of the second compensation control transistor is coupled to the compensation control line, a first electrode of the second compensation control transistor is coupled to the first terminal of the energy storage circuit, and a second electrode of the second compensation control transistor is coupled to the first electrode of the light-emitting element.

Specifically, the energy storage circuit may include a storage capacitor, and the data writing circuit may include a data writing transistor.

A first terminal of the storage capacitor is the first terminal of the energy storage circuit, and a second terminal of the storage capacitor is the second terminal of the energy storage circuit.

A control electrode of the data writing transistor is coupled to the writing control line, a first electrode of the data writing transistor is coupled to a data line, and a second electrode of the data writing transistor is coupled to the first terminal of the energy storage circuit; the data line is configured to input the data voltage.

In a specific implementation, the second light-emitting control circuit may include a second light-emitting control transistor.

A control electrode of the second light-emitting control transistor is coupled to the second light-emitting control line, a first electrode of the second light-emitting control transistor is coupled to the power voltage terminal, and a second electrode of the second light-emitting control transistor is coupled to the first terminal of the driving circuit.

The pixel driving circuit according to the present disclosure will be described with reference to a specific embodiment hereinafter.

Figure 4:
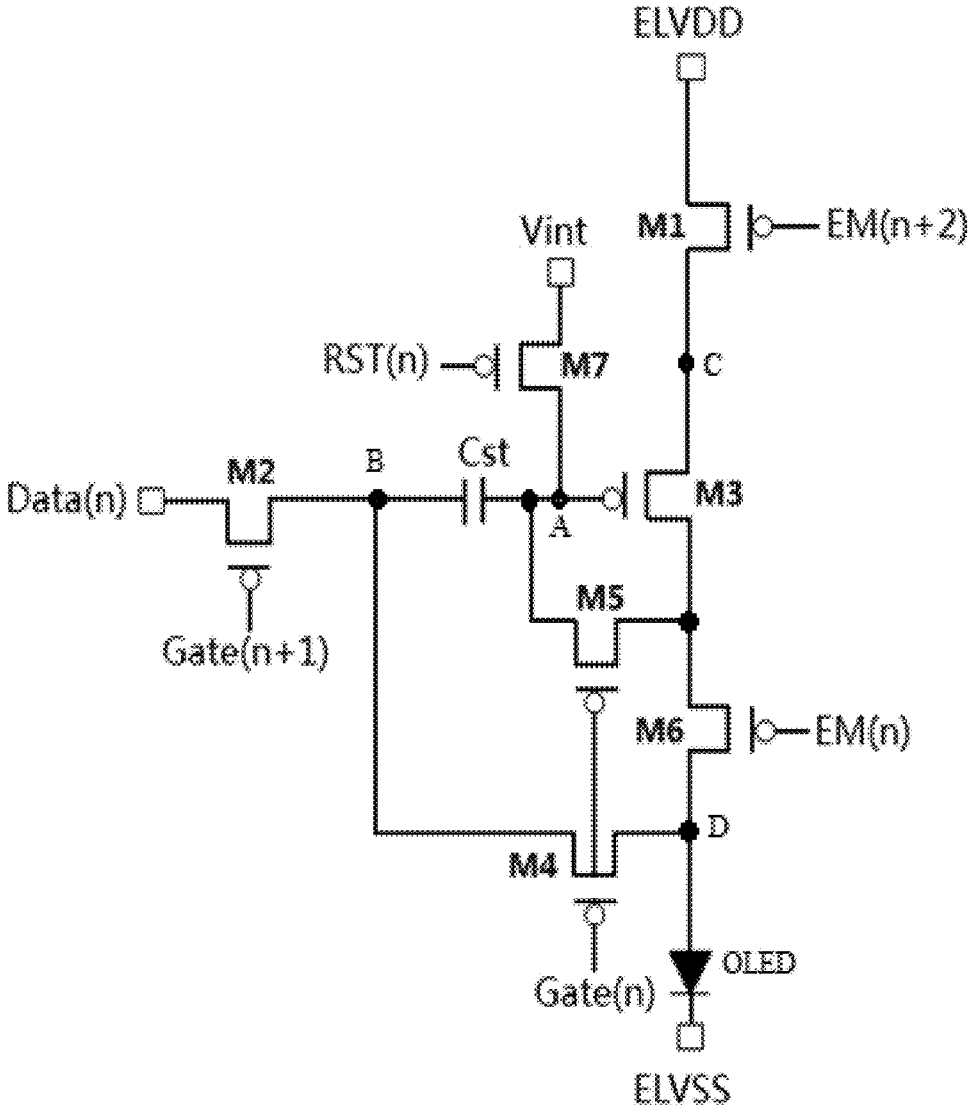
FIG. 4 is a circuit diagram of a specific embodiment of a pixel driving circuit according to the present disclosure.

As shown in FIG. 4, a specific embodiment of the pixel driving circuit according to the present disclosure is configured to drive an organic light-emitting diode (OLED). As shown in FIG. 1 to FIG. 3, the specific embodiment of the pixel driving circuit according to the present disclosure includes the initialization circuit 11, the driving circuit 12, the first light-emitting control circuit 13, the energy storage circuit 14, the data writing circuit 15, the compensation control circuit 16 and the second light-emitting control circuit 17.

The initialization circuit 11 includes an initialization transistor M7. The driving circuit 12 includes a driving transistor M3. The first light-emitting control circuit 13 includes a first light-emitting control transistor M6. The compensation control circuit 16 includes a first compensation control transistor M5 and a second compensation control transistor M4. The energy storage circuit 14 includes a storage capacitor Cst. The data writing circuit 15 includes a data writing transistor M2. The second light-emitting control circuit 17 includes a second light-emitting control transistor M1.

A gate electrode of the initialization transistor M7 is coupled to the initialization control line RST(n), a source electrode of the initialization transistor M7 is coupled to the initialization voltage line, and a drain electrode of the initialization transistor M7 is coupled to a gate electrode of the driving transistor M3. The initialization voltage line is configured to input the initialization voltage Vint.

A gate electrode of the first light-emitting control transistor M6 is coupled to the first light-emitting control line EM(n), a source electrode of the first light-emitting control transistor M6 is coupled to a drain electrode of the driving transistor M3, and a drain electrode of the first light-emitting control transistor M6 is coupled to an anode of the organic light-emitting diode (OLED).

A gate electrode of the first compensation control transistor M5 is coupled to the compensation control line Gate(n), a source electrode of the first compensation control transistor M5 is coupled to the gate electrode of the driving transistor M3, and a drain electrode of the first compensation control transistor M5 is coupled to the drain electrode of the driving transistor M3.

A gate electrode of the second compensation control transistor M4 is coupled to the compensation control line Gate(n), a source electrode of the second compensation control transistor M4 is coupled to a first terminal of the storage capacitor Cst, and a drain electrode of the second compensation control transistor M4 is coupled to an anode of the organic light-emitting diode.

A second terminal of the storage capacitor Cst is coupled to the gate electrode of the driving transistor M3.

A gate electrode of the data writing transistor M2 is coupled to the writing control line Gate(n+1), a source electrode of the data writing transistor M2 is coupled to a data line Data(n), and a drain electrode of the data writing transistor M2 is coupled to the first terminal of the storage capacitor Cst. The data line Data(n) is configured to input the data voltage.

A gate electrode of the second light-emitting control transistor M1 is coupled to the second light-emitting control line EM(n+2), a source electrode of the second light-emitting control transistor M1 is coupled to the power voltage terminal, and a drain electrode of the second light-emitting control transistor M1 is coupled to a source electrode of the driving transistor M3.

Here, as shown in FIG. 4, the power voltage terminal is configured to input the power voltage ELVDD.

In FIG. 4, a low voltage ELVSS is input to the cathode of the OLED, and the cathode voltage terminal is a low voltage terminal for inputting ELVSS, but the disclosure is not limited thereto.

In a specific implementation, the anode of the OLED is the first electrode of the light-emitting element EL, and the cathode of the OLED is the second electrode of the light-emitting element EL.

In FIG. 4, node A is a node coupled to the gate electrode of the M3, node B is a node coupled to the first terminal of the Cst, node C is a node coupled to the source electrode of the M3, and node D is a node coupled to the anode of the OLED.

In the specific embodiment of the pixel driving circuit as shown in FIG. 4, all the transistors are P-type metal-oxide-semiconductor field effect transistors (PMOSFETs), but the disclosure is not limited thereto.

In the specific embodiment of the pixel driving circuit as shown in FIG. 4, the Gate(n) may be a gate line of a nth row, the Gate(n+1) may be a gate line of a (n+1)th row, and the EM(n) may be a light-emitting control line of a nth row, the EM(n+2) may be a light-emitting control line of a (n+2)th row, but the disclosure is not limited thereto. n is a positive integer.

Figure 5:
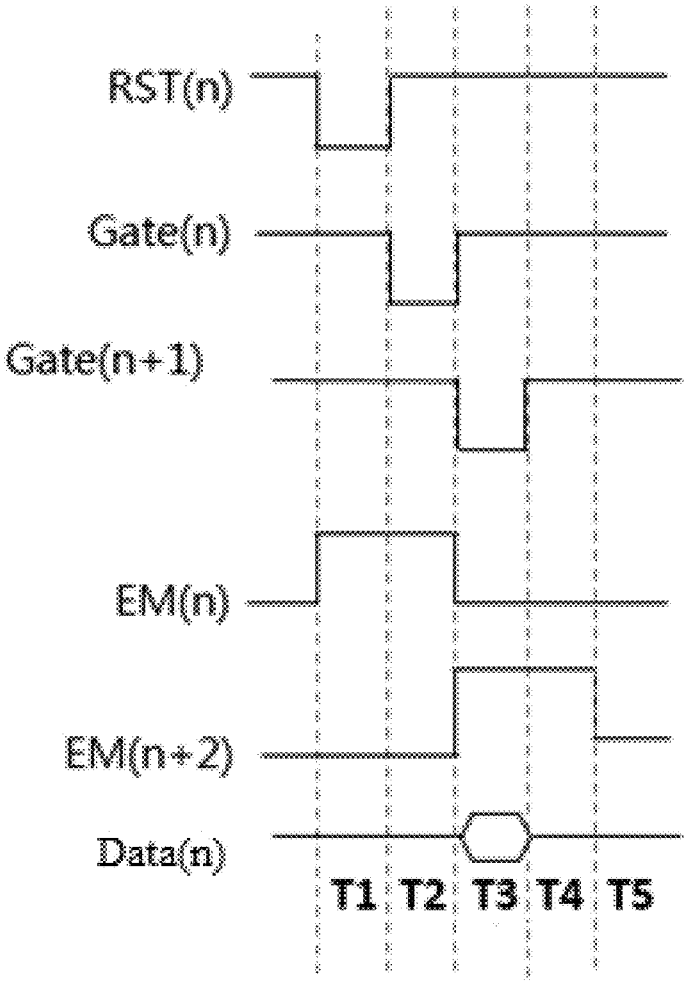
FIG. 5 is an operation timing sequence diagram of the specific embodiment of the pixel driving circuit as shown in FIG. 4 of the present disclosure.
Figure 6:
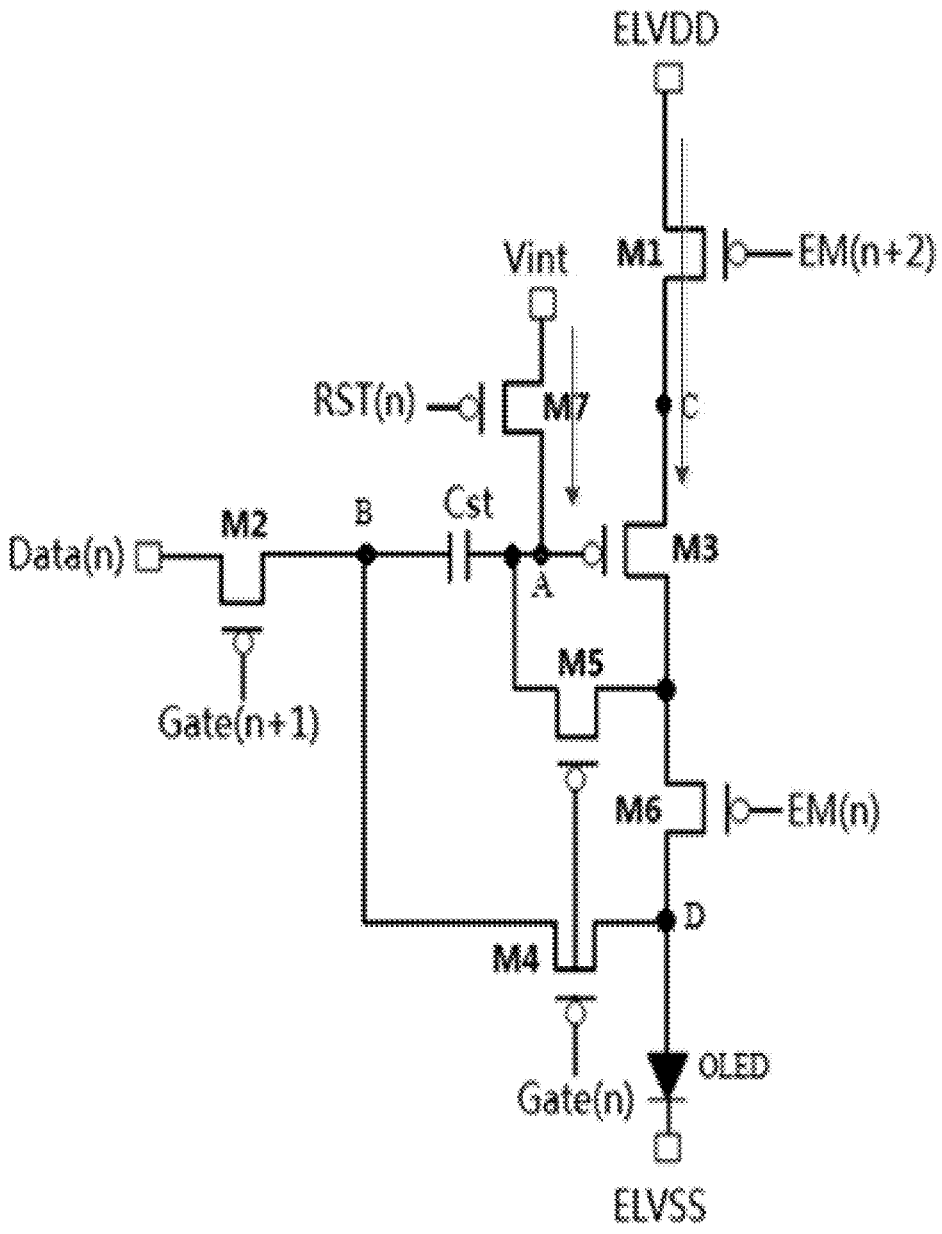
FIG. 6 is a schematic diagram illustrating an operation state of the specific embodiment of the pixel driving circuit according to the present disclosure during an initialization stage T1.

As shown in FIG. 5, when the specific embodiment of the pixel driving circuit as shown in FIG. 4 in the present disclosure is in operation, during an initialization stage T1, a low electrical level is input to both the RST(n) and the EM(n+2), and a high electrical level is input to the Gate(n+1), the Gate(n) and the EM(n). As shown in FIG. 6, the M1, the M3 and the M7 are turned on, and Vint passes through the M7 to reset the gate electrode of the M3, so that a gate voltage of the M3 is Vint. ELVDD passes through the M1 and is input to the source electrode of the M3, so that a source voltage of the M3 is ELVDD. As a result, a gate-source voltage of the M3 is equal to Vint-ELVDD at this time, thereby forming a fixed bias voltage which mitigates the problem of short-term image sticking of the OLED. Since the M6 is turned off, an anode voltage of the OLED gradually drops to V_OLED, which is a turn-on voltage of the OLED. In the specific embodiment of the pixel driving circuit as shown in FIG. 4 of the present disclosure, an electrical potential on the gate electrode of the driving transistor M3 is set to the initialization voltage Vint during the initialization stage by using the initialization transistor M7, to place the driving transistor M3 in an on-bias state, such that regardless of whether a data voltage during a display time of a previous frame corresponds to black or white color, the driving transistor M3 initiates the compensation and data writing processes from the on-bias state.

Figure 7:
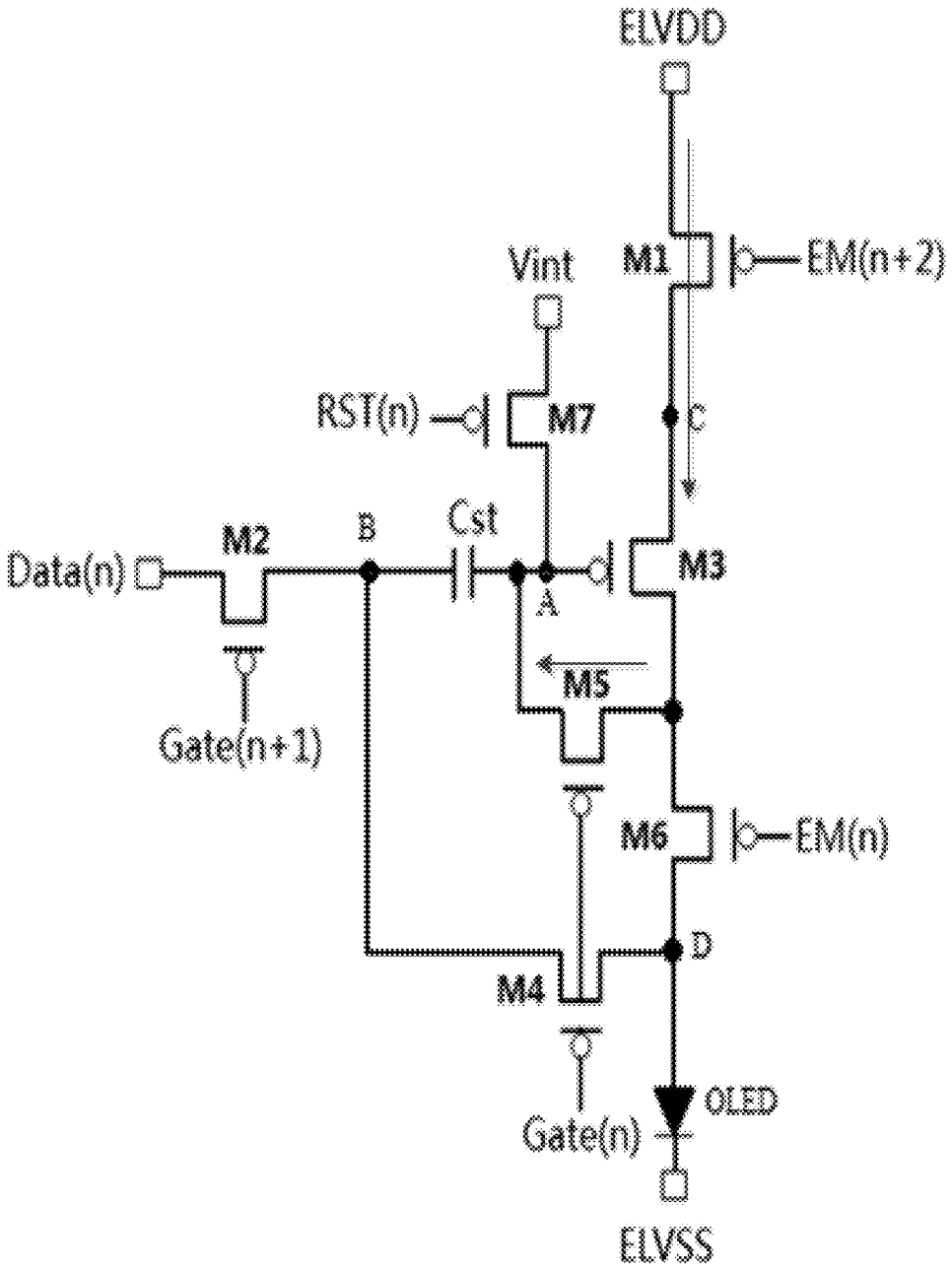
FIG. 7 is a schematic diagram illustrating an operation state of the specific embodiment of the pixel driving circuit according to the present disclosure during a compensation stage T2.

During a compensation phase T2, a low electrical level is input to both the Gate (n) and the EM(n+2), a high electrical level is input to the RST(n), Gate(n+1) and EM(n). As shown in FIG. 7, the M1, the M3, and the M5 are turned on. A voltage at node A starts to increase from Vint until reaching ELVDD+Vth. Vth is a threshold voltage of the M3. At this time, the M3 is turned off, the M4 is turned on, and a turn-on voltage V_OLED of the OLED is written to the node B.

Figure 8:
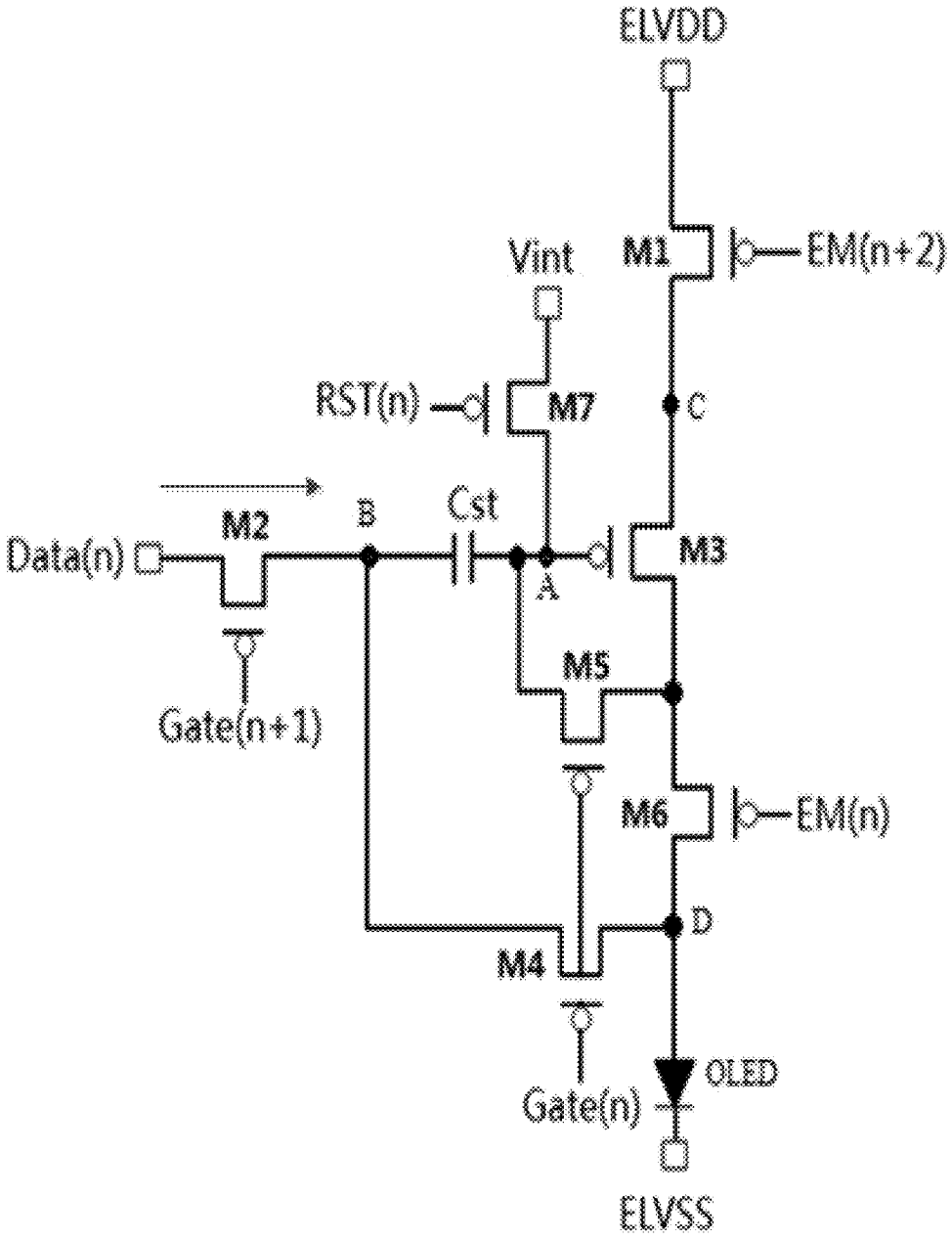
FIG. 8 is a schematic diagram illustrating an operation state of the specific embodiment of the pixel driving circuit according to the present disclosure during a data writing stage T3.

During a data writing stage T3, the data voltage Vdata is output to the Data(n), a low electrical level is input to the Gate(n+1) and the EM(n), and a high electrical level is input to the RST(n), the Gate(n) and the EM(n+2). As shown in FIG. 8, the M2 is turned on, and a voltage at node B jumps from V_OLED to Vdata. Due to the Cst, the electrical potential at node A is coupled from ELVDD+Vth to (ELVDD+Vth)+(Vdata−V_OLED).

During a preliminary light-emitting stage T4, a low electrical level is input to the EM (n), a high electrical level is input to the Gate (n), the Gate (n+1), the RST (n), and the EM (n+2). The voltage at node A remains the same as that in the previous stage, the voltage at node B and a voltage at node D also remain unchanged.

Figure 9:
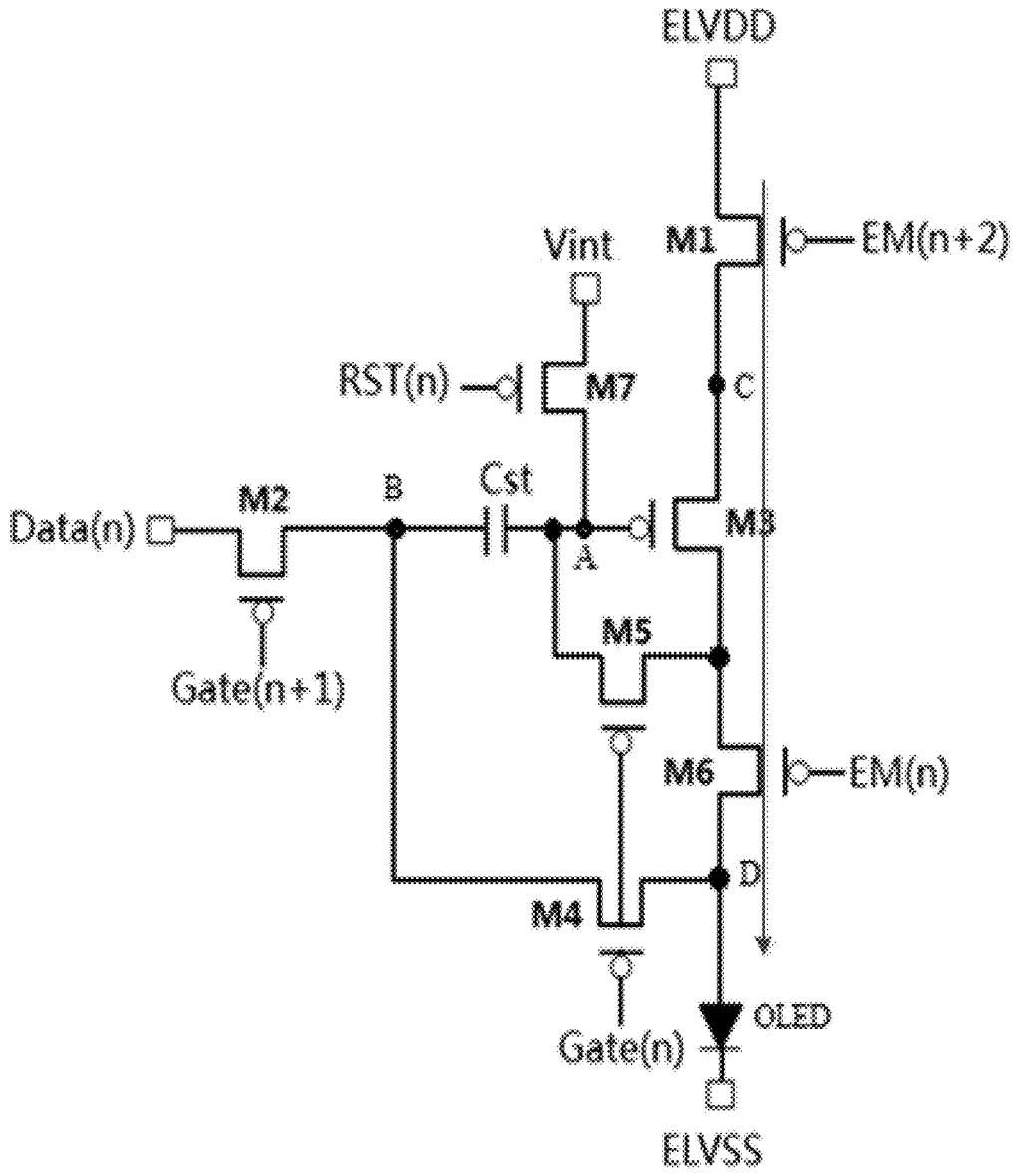
FIG. 9 is a schematic diagram illustrating an operation state of the specific embodiment of the pixel driving circuit according to the present disclosure during a light-emitting stage T5.

During a light-emitting stage T5, a low electrical level is input to both the EM (n+2) and the EM (n). As shown in FIG. 9, the M1, the M3, and the M6 are turned on, and the OLED starts to emit light. A calculation formula of the OLED's light-emitting current holed is as follows:

$$Ioled=K((ELVDD+Vth)\pm(Vdata-V_OLED)-ELVDD-Vth)2=K(Vdata-V_OLED)2;$$

It can be seen from the above that the light-emitting current of the OLED is irrelevant to ELVDD and Vth, thereby eliminating the impact of IR Drop (IR drop refers to a phenomenon of voltage drop or rise occurring in a power and ground network in an integrated circuit) of the power voltage line for inputting ELVDD and a threshold voltage drift of the driving transistor M3 on the OLED light-emitting current, and at the same time mitigating the problem of short-term image sticking of the OLED.

In addition, when the specific embodiment of the pixel driving circuit as shown in FIG. 4 in the present disclosure is in operation, the preliminary light-emitting stage T4 may not be provided. The preliminary light-emitting stage T4 is set in the above steps to perform a second light-emitting control by means of the EM (n+2).

A pixel driving method in an embodiment of the present disclosure is applied to the pixel driving circuit described above. The pixel driving method includes: during an initialization stage, the initialization circuit writes the initialization voltage to the control terminal of the driving circuit under control of the initialization control signal input from the initialization control line, so that the driving circuit brings the connection between the first terminal of the driving circuit and the second terminal of the driving circuit into a conducting state under control of the control terminal of the driving circuit; and the first light-emitting control circuit disconnects the connection between the second terminal of the driving circuit and the light-emitting element under control of the first light-emitting control signal input from the first light-emitting control line.

In the pixel driving method according to the embodiment of the present disclosure, the electrical potential on the control terminal of the driving circuit is set to the initialization voltage during the initialization stage by using the initialization circuit, to place the driving transistor included in the driving circuit in the on-bias state, such that regardless of whether the data voltage during the display time of a previous frame corresponds to black or white color, the driving transistor included in the driving circuit initiates the compensation and data writing processes from the on-bias state.

In a specific implementation, the pixel driving circuit may further include the energy storage circuit, the compensation control circuit, and the second light-emitting control circuit, and the compensation stage is further provided after the initialization stage. The pixel driving method further includes: during the compensation stage, the second light-emitting control circuit brings the connection between the first terminal of the driving circuit and the power voltage terminal into a conducting state under control of the second light-emitting control signal input from the second light-emitting control line; the compensation control circuit brings the connection between the control terminal of the driving circuit and the second terminal of the driving circuit into a conducting state and brings the connection between the first electrode of the light-emitting element and the first terminal of the energy storage circuit into a conducting state under control of the compensation control signal input from the compensation control line; and the driving circuit brings the connection between the first terminal of the driving circuit and the second terminal of the driving circuit into a conducting state under control of the control terminal of the driving circuit to charge the energy storage circuit with the power voltage ELVDD input from the power voltage terminal, so as to increase the electrical potential on the control terminal of the driving circuit until the driving circuit disconnects the connection between the first terminal of the driving circuit and the second terminal of the driving circuit under control of the control terminal of the driving circuit.

Specifically, the pixel driving circuit further includes the data writing circuit, and the data writing stage and the light-emitting stage are further provided after the compensation stage. The pixel driving method further includes: during the data writing stage, the data writing circuit writes the data voltage to the first terminal of the energy storage circuit under control of the writing control signal input from the writing control line so as to change the electrical potential on the second terminal of the energy storage circuit accordingly; during the light-emitting stage, the first light-emitting control circuit brings the connection between the second terminal of the driving circuit and the first electrode of the light-emitting element into a conducting state under control of the first light-emitting control signal input from the first light-emitting control line, the second light-emitting control circuit brings the connection between the first terminal of the driving circuit and the power voltage terminal into a conducting state under control of the second light-emitting control signal and the driving circuit drives the light-emitting element to emit light.

A display device in the embodiment of the present disclosure includes the pixel driving circuit described above. The display device provided by the embodiment of the present disclosure may be any product or component having a display function, such as a mobile phone, a tablet computer, a television set, a display, a notebook computer, a digital photo frame, or a navigator.

It should be appreciated that a person of ordinary skill in the art may make further modifications and improvements without departing from the principle of the present disclosure, and these modifications and improvements shall also be deemed as being within the scope of the present disclosure.

What is claimed is:

1. A pixel driving circuit, comprising:

an initialization circuit;

a driving circuit; and a first light-emitting control circuit, wherein a first terminal of the driving circuit is coupled to a power voltage terminal, a second terminal of the driving circuit is coupled to a light-emitting element via the first light-emitting control circuit, wherein the initialization circuit is configured to write an initialization voltage to a control terminal of the driving circuit under control of an initialization control signal input from an initialization control line, so that the driving circuit brings a connection between the first terminal of the driving circuit and the second terminal of the driving circuit into a conducting state under control of the control terminal of the driving circuit, wherein the first light-emitting control circuit is configured to bring a connection between the second terminal of the driving circuit and the light-emitting element into a conducting state under control of a first light-emitting control signal input from a first light-emitting control line, wherein the pixel driving circuit further comprises: an energy storage circuit, a data writing circuit, and a compensation control circuit, wherein the data writing circuit is configured to write a data voltage to a first terminal of the energy storage circuit under control of a writing control signal input from a writing control line; a second terminal of the energy storage circuit is coupled to the control terminal of the driving circuit, wherein the compensation control circuit is configured to bring a connection between the control terminal of the driving circuit and the second terminal of the driving circuit into a conducting state and write a first voltage to the first terminal of the energy storage circuit under control of a compensation control signal input from a compensation control line, and wherein the compensation control circuit is configured to bring a connection between the first terminal of the energy storage circuit and a first electrode of the light-emitting element into a conducting state under control of the compensation control signal, so as to write the first voltage to the first terminal of the energy storage circuit.

2. The pixel driving circuit according to claim 1, further comprising:

a second light-emitting control circuit; wherein the first terminal of the driving circuit is coupled to the power voltage terminal via the second light-emitting control circuit, and the second light-emitting control circuit is configured to bring a connection between the first terminal of the driving circuit and the power voltage terminal into a conducting state under control of a second light-emitting control signal input from a second light-emitting control line.

3. The pixel driving circuit according to claim 2, wherein the second light-emitting control circuit comprises a second light-emitting control transistor;

a control electrode of the second light-emitting control transistor is coupled to the second light-emitting control line, a first electrode of the second light-emitting control transistor is coupled to the power voltage terminal, and a second electrode of the second light-emitting control transistor is coupled to the first terminal of the driving circuit.

4. The pixel driving circuit according to claim 1, wherein the initialization circuit comprises an initialization transistor;

a control electrode of the initialization transistor is coupled to the initialization control line, a first electrode of the initialization transistor is coupled to an initialization voltage line, and a second electrode of the initialization transistor is coupled to the control terminal of the driving circuit; the initialization voltage line is configured to input the initialization voltage.

5. The pixel driving circuit according to claim 4, wherein each transistor is a triode.

6. The pixel driving circuit according to claim 4, wherein each transistor is a thin film transistor.

7. The pixel driving circuit according to claim 4, wherein each transistor is a field effect transistor.

8. The pixel driving circuit according to claim 7, wherein each transistor is a P-type metal-oxide-semiconductor field effect transistor (PMOSFET).

9. The pixel driving circuit according to claim 1, wherein the first light-emitting control circuit comprises a first light-emitting control transistor;

a control electrode of the first light-emitting control transistor is coupled to the first light-emitting control line, a first electrode of the first light-emitting control transistor is coupled to the second terminal of the driving circuit, and a second electrode of the first light-emitting control transistor is coupled to a first electrode of the light-emitting element.

10. The pixel driving circuit according to claim 1, wherein the driving circuit comprises a driving transistor;

a control electrode of the driving transistor is the control terminal of the driving circuit, a first electrode of the driving transistor is the first terminal of the driving circuit, a second electrode of the driving transistor is the second terminal of the driving circuit.

11. The pixel driving circuit according to claim 1, wherein the compensation control circuit comprises a first compensation control transistor and a second compensation control transistor, wherein a control electrode of the first compensation control transistor is coupled to the compensation control line, a first electrode of the first compensation control transistor is coupled to the control terminal of the driving circuit, and a second electrode of the first compensation control transistor is coupled to the second terminal of the driving circuit; and a control electrode of the second compensation control transistor is coupled to the compensation control line, a first electrode of the second compensation control transistor is coupled to the first terminal of the energy storage circuit, and a second electrode of the second compensation control transistor is coupled to a first electrode of the light-emitting element.

12. The pixel driving circuit according to claim 1, wherein the energy storage circuit comprises a storage capacitor, and the data writing circuit comprises a data writing transistor, wherein a first terminal of the storage capacitor is the first terminal of the energy storage circuit, and a second terminal of the storage capacitor is the second terminal of the energy storage circuit; and a control electrode of the data writing transistor is coupled to the writing control line, a first electrode of the data writing transistor is coupled to a data line, and a second electrode of the data writing transistor is coupled to the first terminal of the energy storage circuit; the data line is configured to input the data voltage.

13. The pixel driving circuit according to claim 1, wherein the pixel driving circuit is of a 7T1C configuration comprising seven transistors and one capacitor.

14. A pixel driving method, applied to the pixel driving circuit according to claim 1, comprising:

during an initialization stage, writing, by the initialization circuit, the initialization voltage to the control terminal of the driving circuit under control of the initialization control signal input from the initialization control line, so that the driving circuit brings the connection between the first terminal of the driving circuit and the second terminal of the driving circuit into a conducting state under control of the control terminal of the driving circuit; and disconnecting, by the first light-emitting control circuit, the connection between the second terminal of the driving circuit and the light-emitting element under control of the first light-emitting control signal input from the first light-emitting control line.

15. The pixel driving method according to claim 14, wherein the pixel driving circuit further comprises an energy storage circuit, a compensation control circuit, and a second light-emitting control circuit, a compensation stage is further provided after the initialization stage, and the pixel driving method further comprises:

during the compensation stage, bringing, by the second light-emitting control circuit, a connection between the first terminal of the driving circuit and the power voltage terminal into a conducting state under control of a second light-emitting control signal input from a second light-emitting control line;

bringing, by the compensation control circuit, a connection between the control terminal of the driving circuit and the second terminal of the driving circuit into a conducting state and bringing, by the compensation control circuit, a connection between a first electrode of the light-emitting element and a first terminal of the energy storage circuit into a conducting state under control of a compensation control signal input from a compensation control line; and bringing, by the driving circuit, the connection between the first terminal of the driving circuit and the second terminal of the driving circuit into a conducting state under control of the control terminal of the driving circuit to charge the energy storage circuit with a power voltage input from the power voltage terminal, so as to increase an electrical potential on the control terminal of the driving circuit until the driving circuit disconnects the connection between the first terminal of the driving circuit and the second terminal of the driving circuit under control of the control terminal of the driving circuit.

16. The pixel driving method according to claim 15, wherein the pixel driving circuit further comprises a data writing circuit, a data writing stage and a light-emitting stage are further provided after the compensation stage; the pixel driving method further comprises:

during the data writing stage, writing, by the data writing circuit, a data voltage to the first terminal of the energy storage circuit under control of a writing control signal input from a writing control line so as to change an electrical potential on a second terminal of the energy storage circuit accordingly;

during the light-emitting stage, bringing, by the first light-emitting control circuit, a connection between the second terminal of the driving circuit and the first electrode of the light-emitting element into a conducting state under control of a first light-emitting control signal input from a first light-emitting control line;

bringing, by the second light-emitting control circuit, a connection between the first terminal of the driving circuit and the power voltage terminal into a conducting state under control of a second light-emitting control signal; and driving, by the driving circuit, the light-emitting element to emit light.

17. A display device comprising the pixel driving circuit according to claim 1.

18. The display device according to claim 17, wherein the display device is an organic light-emitting diode (OLED) display device.

* * * * *